US007766283B2

(12) United States Patent
Lesemann et al.

(10) Patent No.: US 7,766,283 B2
(45) Date of Patent: Aug. 3, 2010

(54) DEVICE FOR DISPLACING A TONGUE BLADE IN ADDITION TO A HEIGHT-ADJUSTABLE ROLLER DEVICE

(75) Inventors: Bernd Lesemann, Breckerfeld (DE); Frank Bornscheuer, Ennepetal (DE)

(73) Assignee: CDP Bharat Forge GmbH, Ennepetal (DE)

( * ) Notice: Subject to any disclaimer, the term of this patent is extended or adjusted under 35 U.S.C. 154(b) by 744 days.

(21) Appl. No.: 10/587,174

(22) PCT Filed: Jan. 28, 2005

(86) PCT No.: PCT/EP2005/000866

§ 371 (c)(1),
(2), (4) Date: Apr. 9, 2007

(87) PCT Pub. No.: WO2005/073465

PCT Pub. Date: Aug. 11, 2005

(65) Prior Publication Data

US 2007/0284484 A1 Dec. 13, 2007

(30) Foreign Application Priority Data

Jan. 30, 2004 (DE) ..... 10 2004 004 784

(51) Int. Cl.
*E01B 7/00* (2006.01)

(52) U.S. Cl. ..... 246/453; 246/452; 246/442; 246/443

(58) Field of Classification Search ..... 246/442, 246/444, 452, 453
See application file for complete search history.

(56) References Cited

U.S. PATENT DOCUMENTS

| | | | | | |
|---|---|---|---|---|---|
| 224,157 | A | * | 2/1880 | Donkersley | 246/430 |
| 5,356,224 | A | * | 10/1994 | Durchschlag | 384/41 |
| 5,390,881 | A | * | 2/1995 | Benenowski et al. | 246/453 |
| 5,499,786 | A | * | 3/1996 | Durchschlag et al. | 246/448 |
| 5,501,418 | A | * | 3/1996 | Humphrey et al. | 246/453 |
| 5,622,340 | A | * | 4/1997 | Turner et al. | 246/415 R |

(Continued)

FOREIGN PATENT DOCUMENTS

| | | |
|---|---|---|
| DE | 1 658 366 | 10/1970 |

(Continued)

*Primary Examiner*—Mark T Le
*Assistant Examiner*—Jason C Smith
(74) *Attorney, Agent, or Firm*—Finnegan, Henderson, Farabow, Garrett & Dunner, L.L.P.

(57) ABSTRACT

The invention relates to a device (1) which is used to lift and displace the tongue blade (2) of a rail (6), comprising at least two rollers (12, 14) whereby the axes thereof are arranged in an essentially parallel manner in relation to a running rail (4), in order to displace the tongue blade (2) in a transversal manner in relation to the running rail (4), at least two support carrier pins (22, 24) which respectively support a roller (12, 14), and a base body (8) which supports the carrier pins (22, 24). The rollers (12, 14) have a projection which projects in at least one first direction in relation to the base body (8). The inventive device is characterised in that a covering (10) is arranged between at least two adjacent rollers and is oriented towards the first direction and at least partially covers a passage between the at least two adjacent rollers (12, 14).

26 Claims, 5 Drawing Sheets

U.S. PATENT DOCUMENTS

| | | | | |
|---|---|---|---|---|
| 5,628,480 | A * | 5/1997 | Vrsecky et al. | 246/453 |
| 6,189,840 | B1 * | 2/2001 | Mantovan et al. | 246/453 |
| 6,464,177 | B1 * | 10/2002 | Heim | 246/453 |
| 6,955,326 | B2 * | 10/2005 | O'Brien et al. | 246/453 |
| 7,063,293 | B2 * | 6/2006 | Leitner et al. | 246/453 |
| 2002/0079634 | A1 * | 6/2002 | Lesemann | 269/309 |
| 2005/0161555 | A1 * | 7/2005 | Leitner et al. | 246/453 |
| 2007/0284484 | A1 * | 12/2007 | Lesemann et al. | 246/442 |
| 2008/0087773 | A1 * | 4/2008 | Meyer | 246/453 |

FOREIGN PATENT DOCUMENTS

| | | | |
|---|---|---|---|
| DE | 40 41 264 | A1 | 6/1992 |
| DE | 196 23 269 | A1 | 12/1997 |
| DE | 101 16 041 | A1 | 10/2002 |
| EP | 495160 | A1 * | 7/1992 |
| EP | 0 700 474 | B1 | 11/1993 |
| EP | 0 692 570 | B1 | 7/1996 |
| GB | 2367084 | A * | 3/2002 |

* cited by examiner

DEVICE FOR DISPLACING A TONGUE BLADE IN ADDITION TO A HEIGHT-ADJUSTABLE ROLLER DEVICE

TECHNICAL FIELD

The present invention relates to a device for lifting and displacing a tongue blade of a switch.

PRIOR ART

Devices of the type mentioned initially, which are also referred to as tongue lifting devices, are widespread in the prior art and are used to make the reversal of a switch in rail systems easier by displacing a tongue blade.

Thus, for example, EP 0 692 570 B1 discloses a tongue lifting device with two rollers, which are pivotably supported on an adjustable tongue lifting clamp that is pretensioned by a spring. Such components have proven expedient in practical use. They do, however, have a comparatively complex structural design. Furthermore, it has been shown that the known tongue lifting devices are susceptible in respect of the infiltration of dirt, ballast and other environmental effects arising in the vicinity of rail systems. This can lead to malfunctions or damage to the tongue lifting devices, which significantly impairs their operational reliability. As a result, the tongue lifting devices frequently have to be checked and maintained. In addition, precautions have to be taken, for example when embedding in the vicinity of the tongue lifting devices, to prevent ballast from entering the tongue lifting device, which is laborious and time-consuming.

SUMMARY OF THE INVENTION

The object of the invention is, therefore, to provide a tongue lifting device of the type referred to initially, which has a simple structural design and increased operational reliability. This object is achieved according to the invention by a device for lifting and displacing the tongue blade of a switch, with at least two rollers, the axes of which are disposed substantially parallel to a running rail in order to displace the tongue blade transversely to the running rail, at least two support carrier pins, each of which supports a roller, and a base body, which supports the support carrier pins, whereby the rollers have a projection in at least one first direction in relation to the base body, characterised in that provided between at least two adjacent rollers is a covering which is oriented towards the first direction and at least partially covers a passage between the at least two adjacent rollers and that the base body has at least one bottom section as well as one top section disposed so as to be displaceable on the bottom section, whereby the direction of displacement between the bottom section and the to section is disposed at an angle to the plane of displacement of the tongue blade.

The invention is based on the knowledge that the operational reliability of tongue lifting devices is endangered especially by the infiltration of foreign substances in the area between adjacent rollers. Proceeding from this knowledge, the invention provides that, in a generic tongue lifting device, a covering is provided between at least two adjacent rollers and is oriented towards the first direction and at least partially covers a passage between the at least two adjacent rollers.

It is achieved by means of this quasi innovative and structurally simple measure that the tongue lifting device according to the invention is effectively protected against undesirable foreign substances especially in the safety-related area between the rollers. It is possible as a result of this to considerably increase the operational reliability of the tongue lifting device whilst at the same time dramatically decreasing the expenditure for maintenance and repair. Furthermore, no precautions are necessary, for example when embedding.

In addition, in a two-part embodiment of the base body in which a top section is mounted so as to be displaceable on a bottom section and the displacement takes place due to the special design of the contact edges of both sections at an angle to the tongue blade's displacement plane towards the running rail, the invention provides a possibility of adjusting the roller device in its height. This may especially be necessary if the intention is to compensate subsidence of one or a plurality of sleepers to which the base plate is bolted making it possible for the tongue blade always to be supported and preferably to the same extent by all roller devices even during operation of the switch for any length of time.

To enable such a height adjustment of the roller bearing, in a preferred embodiment of the invention, the base body is divided into a top section and a bottom section whereby the rollers are mounted on the top section of the base body and the top and bottom sections are disposed so as to be displaceable against each other. In this regard, height adjustment of the roller bearing takes place by means of inclined faces formed continuously or step-like in the contact edges of the top and bottom section, said edges lying in contact on top of each other. This ensures that the upper side of the top section is parallel to the tongue blade's displacement direction in every state of displacement.

In a preferred embodiment of the present invention, displacement of the bottom section and top section may take place continuously due to the design of the contact edges with corresponding inclined faces, whereby it is possible to locate the top section on the bottom section in any intermediate position and thus achieve any height adjustment desired between a minimum and a maximum value.

In an alternative preferred embodiment of the present invention there may be one or a plurality of steps formed in the substantially inclined contact edges of the top and bottom section, as a result of which displacement and height adjustment can take place in steps between a minimum and a maximum value. In connection with this an especially safe and easily fixed support is provided for the top section on the bottom section due to the design of the steps.

In this regard, height adjustment of the roller device usually takes place manually and preferably by means of loosening the means for fixing the top section to the bottom section in its arbitrary displacement and height position, carrying out an adjustment or readjustment of the height by displacing the top section on the bottom section and finally retightening the means for fixing, preferably bolts.

In an especially preferred embodiment of the invention, displacement of the top section on the bottom section is carried out in a continuously displaceable top section by way of a device for displacing said top section. In a quite especially preferred embodiment, this device for displacement is a threaded rod, which joins the top section to the bottom section. In an extremely preferred embodiment of the invention, on its free end projecting from the base body this threaded rod also has an element for engaging a conventional tool, for example a hexagon head.

As a result of this, a device is created which can be adjusted at will especially easily and preferably continuously and within broad limits using thoroughly conventional tools. The design and disposition of the covering provided between adjacent rollers may be specified according to the type and scope of the environmental effects to be anticipated.

According to a development of the present invention, however, it is preferable for the covering to be at a distance of 5.0 mm at most, especially preferably 3.0 mm at most, from the outer circumference of the at least two adjacent rollers. As a result of this, it is possible to achieve a satisfactory level of operational reliability for most application cases without the need for expensive manufacture or increased fabrication tolerances.

According to a development of the present invention it is further provided that the base body is formed as a casting which is preferably moulded integrally with the covering. The result of this is a simple and simultaneously sturdy and low-deformation structural design which results in conjunction with the high level of operational reliability in a long service life and in the tongue lifting device according to the invention being largely maintenance-free.

Nowadays high demands are also made in respect of soft positioning operation of the tongue lifting device. In order to satisfy these demands, according to a development of the invention it is provided that at least one roller has a projection in the first direction in relation to a reference point of the base body, which is larger than that of the remaining rollers. As a result of such graduated roller projections it is possible for lifting of the tongue blade to take place step by step, which not only results in soft operation but also reduces the positioning forces necessary for lifting the tongue blade. In this regard it is especially preferable that a first and a second roller are provided whereby the first roller has a projection of 2.0 to 3.0 mm and the second roller has a projection of 3.0 to 4.0 mm in the first direction in relation to the base body.

It also counts towards the aspect of operational reliability that proper installation of the tongue lifting device must be ensured from the beginning, and that even during conversion measures incorrect reinstallation of the tongue lifting device must be ruled out. Against this background, it is provided according to a development of the invention that the base body is provided with an identification mark which indicates the projection of the rollers in each case. The result of this is that handling errors whilst installing and removing the tongue lifting device are effectively ruled out.

The design of the support pins may be carried out in a variety of ways within the scope of the present invention. According to a development of the present invention, however, it is preferable that the support carrier pins should each have at least one limit stop element, especially a collar, whereby the limit stop element limits an insertion depth of the support carrier pins into the base body. Simple and simultaneously reliable locking of the support carrier pins in the base body is ensured by this measure, especially in conjunction with a ribbed plate disposed in the vicinity of said limit stop elements.

The operational reliability and durability of tongue lifting devices is determined against the background of the high loads which act on the tongue lifting device, also significantly by the type of support of the rollers on the support carrier pins. According to a development of the present invention, it is, therefore, provided that the rollers are supported on the support carrier pins by friction bearings that are preferably formed by a synthetic polymer layer provided between an inner circumferential surface of the rollers and an outer circumferential surface of the support carrier pins. Such friction bearings have proven to be notably durable whilst at the same time they ensure smooth-running and soft operation on lifting and displacing the tongue blade. In this regard it is especially preferable for the synthetic polymer layer to have self-lubricating properties in order to guarantee the advantageous properties of the friction bearing permanently.

Frequently different positioning areas for lifting and displacing the tongue blade arise depending on the geometry and the spatial conditions in the vicinity of the tongue blade to be lifted. Against this background, in order to broaden the range when using the tongue lifting device according to the invention, it is provided according to a development of the invention that the base body has a symmetrical axis which extends parallel to the rollers. In this manner, it is possible within a specific rail system to install the tongue lifting device in different positions in relation to the axis of symmetry depending on the prevailing boundary conditions without altering the basic function of the tongue lifting device.

Furthermore, the principles of the present invention are applicable to both adjustable and non-adjustable tongue lifting devices. However, in view of the operational reliability and simple structural design aimed for, it is preferable according to the invention that the at least two support carrier pins are provided so as to be substantially incapable of displacement on the base body.

DETAILED DESCRIPTION OF PREFERRED EMBODIMENTS

Preferred embodiments of the present invention will be described in the following with reference to the accompanying drawings.

Figure 1:
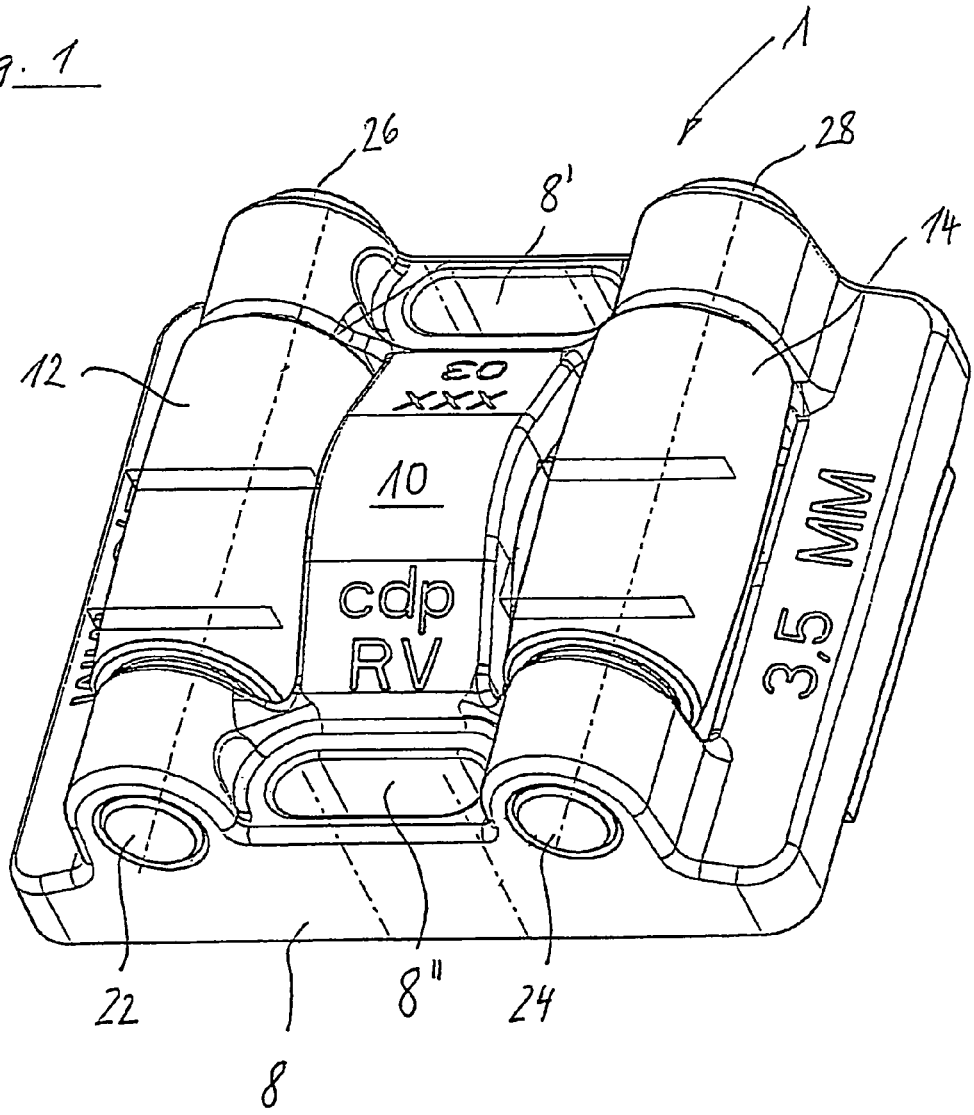
FIG. 1 shows a schematic perspective view of a first embodiment of the tongue lifting device according to the invention.

FIG. 1 shows a schematic perspective view of a tongue lifting device 1 as first embodiment of the present invention. Tongue lifting device 1 has a base body 8, in which two support carrier pins 22, 24 are supported. Support carrier pins 22, 24 serve to pivotably support one roller 12, 14 respectively in tongue lifting device 1. In addition base body 8 has two fixing apertures 8', 8", to fix tongue lifting device 1 in its installation position.

The first embodiment shown in FIG. 1 has two rollers 12, 14. However, it should be noted that three or even more rollers may be provided depending on the prevailing requirements, for example the required positioning range.

Between two adjacent rollers 12, 14 is provided a covering 10 which is oriented towards a first direction whereby the first direction in the present embodiment extends vertically upwards. The covering is designed such that it at least partially covers a passage present between two adjacent rollers 12, 14. For this purpose, in the present invention, covering 10 is introduced at a distance of approx. 4 mm to the outer circumference of two adjacent rollers 12, 14. In this manner it is possible to effectively prevent the infiltration of undesirable foreign substances such as ballast or similar.

The covering is designed as a curved shape in the present invention with the result that no permanent deposits form on the covering. In addition, covering 10 is moulded integrally with the base body as a one-piece casting. It is, however, self-evident that base body 8 and covering 10 may also be manufactured in several parts and optionally of different materials.

As may best be seen in FIGS. 4 and 5, which will be explained in greater detail later, rollers 12 and 14 have a projection in the first direction, i.e. in the vertical direction, in relation to the top edge (the highest point in the first direction) of covering 10, to enable trouble-free displacement of a tongue blade along tongue lifting device 1. These projections may basically be the same in all the rollers. In the present embodiment, however, roller 14 has a larger projection than roller 12 to enable soft and continuous lifting of a tongue blade. In this case the projection in the present embodiment is 2.5 mm in roller 12 and 3.5 mm in roller 14. It is expedient to set the highest point (in the first direction) of base body 8 as the reference point for the projection.

To ensure and speed up correct installation of tongue lifting device 1, an identification mark is provided next to each of rollers 12, 14 which indicates the projection of the rollers in each case.

Support carrier pins 22, 24 are, as can be seen in FIG. 1, inserted into base body 8 through eye-like bearing apertures therein. To ensure a correct insertion depth of carrier support pins 22, 24 into base body 8, carrier pins 22, 24 each have a limit stop element 26, 28 at one end in the shape of a washer-like head or similar. Further locking or fixing measures of carrier support pins 22, 24 are not then necessary if limit stop elements 26, 28 are in contact backwards with a ribbed plate or similar in the installed condition, which will be described later.

Rollers 12, 14 are pivotably supported on carrier support pins 22, 24 whereby in principle any bearing support may be used. However, for the present application case it has proven advantageous to use friction bearings, which are preferably formed by a synthetic polymer coating provided between an inner circumferential surface of rollers 12, 14 and an outer circumferential surface of support carrier pins 22, 24. The result, especially with self-lubricating properties of the synthetic polymer coating, is reliable operation and a long service life of tongue lifting device 1.

Figure 2:
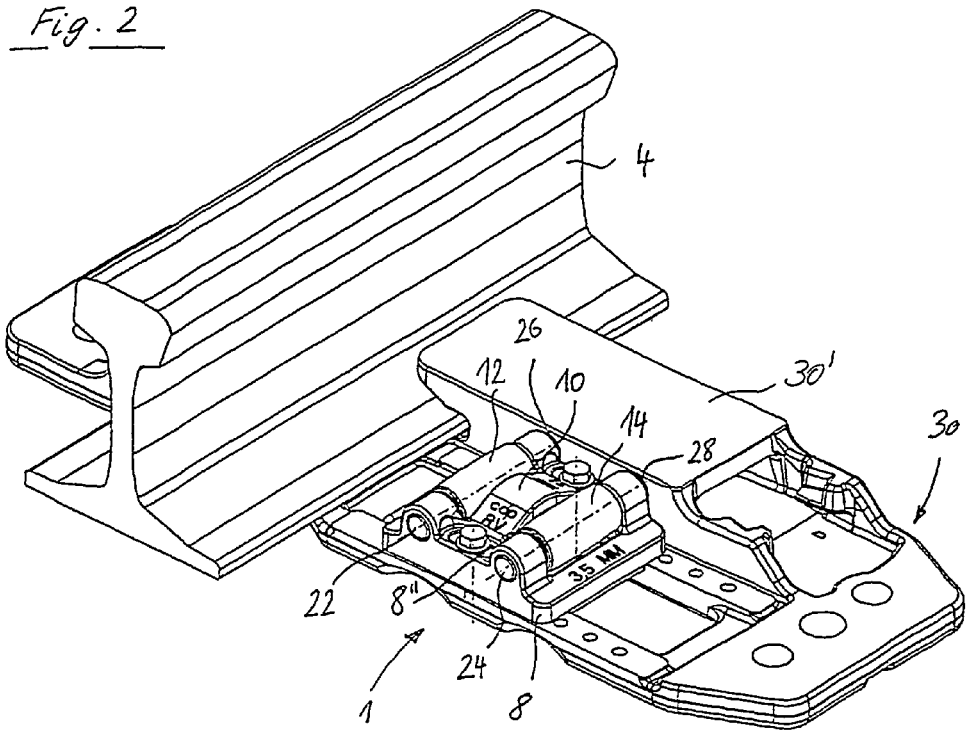
FIG. 2 shows a schematic perspective view of the tongue lifting device from FIG. 1 in the installed condition although without tongue blade.
Figure 3:
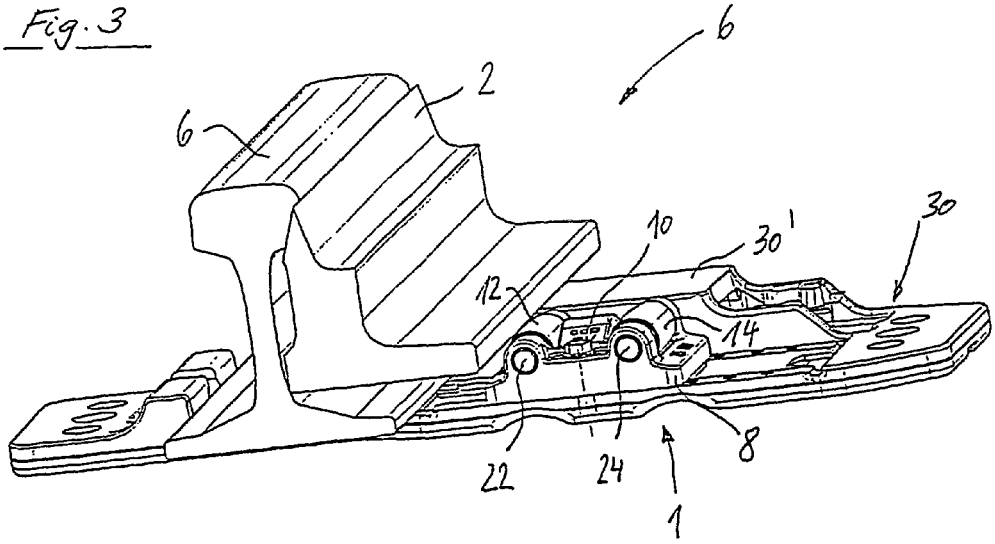
FIG. 3 shows a schematic perspective view of the tongue lifting device from FIG. 1 in the installed condition with a tongue blade in the lowered state.

FIGS. 2 and 3 each show a schematic perspective view of tongue lifting device 1 from FIG. 1 in the installed condition without and with a tongue blade 4 respectively. As can be seen in FIG. 2, in the installed condition tongue lifting device 1 is mounted on a ribbed plate 30. In this case tongue lifting device 1 is attached by way of bolts which extend through fixing apertures 8', 8" and are anchored in threaded holes of ribbed plate 30. In addition, in the installed condition, limit stop elements 26, 28 are in contact with ribbed plate 30 with their external surface with the result that displacement of support carrier pins 22, 24 in the one or the other direction is excluded.

As can be seen in FIG. 3, a tongue blade lies in contact in the lowered state on the sliding or supporting surface 30' of the ribbed plate and is located next to tongue lifting device 1. FIG. 4 also shows this condition in a schematic sectional view. In this case tongue blade 2 in FIG. 4 is in contact on the left-hand side with stock rail 4 and on the right-hand side in FIG. 4 touches roller 12 of the tongue lifting device.

Figure 4:
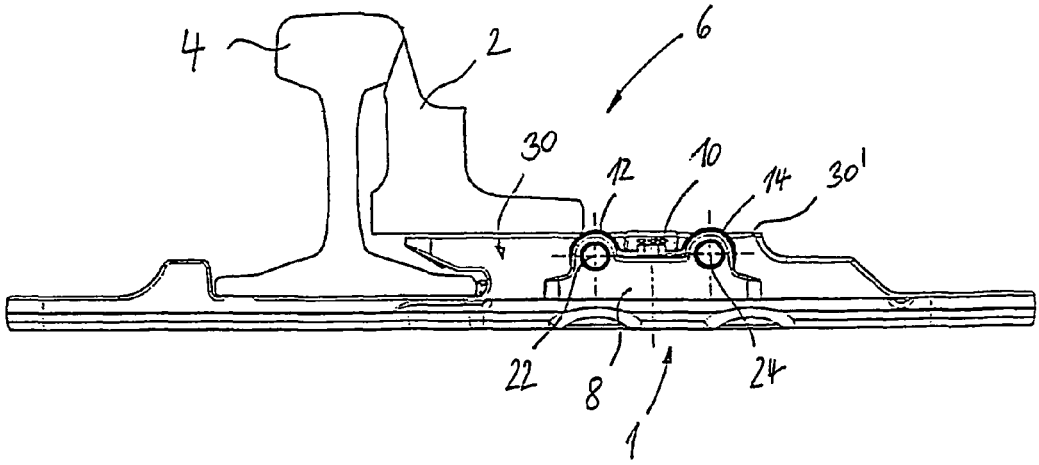
FIG. 4 shows a schematic sectional view of the tongue lifting device from FIG. 1 with a tongue blade in the lowered state.
Figure 5:
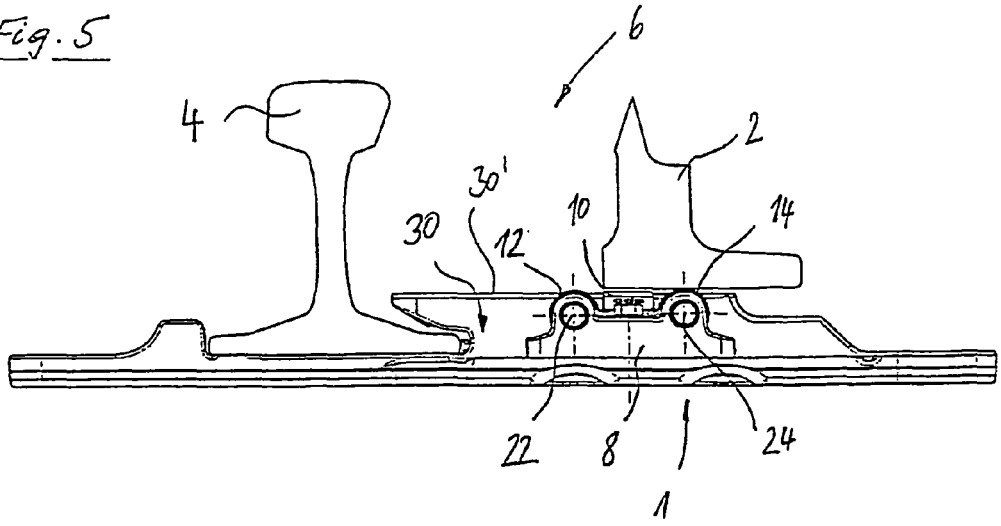
FIG. 5 shows a schematic sectional view of the tongue lifting device from FIG. 1 in the installed condition with raised tongue blade.

To lift tongue blade 2, said blade is displaced towards the right in FIG. 4 by means of an appropriate actuator in order to reach the state shown in FIG. 5. In the course of this displacement the tongue blade is first lifted by roller 12 with the result that it lifts off supporting surface 30' of ribbed plate 30. With a further displacement, tongue blade 2 reaches roller 14 of the tongue lifting device and is lifted further corresponding to the additional projection of roller 14. In practice during the whole time that tongue blade 2 is being displaced, it is detached from supporting surface 30' which results in soft positioning operation.

Figure 6:
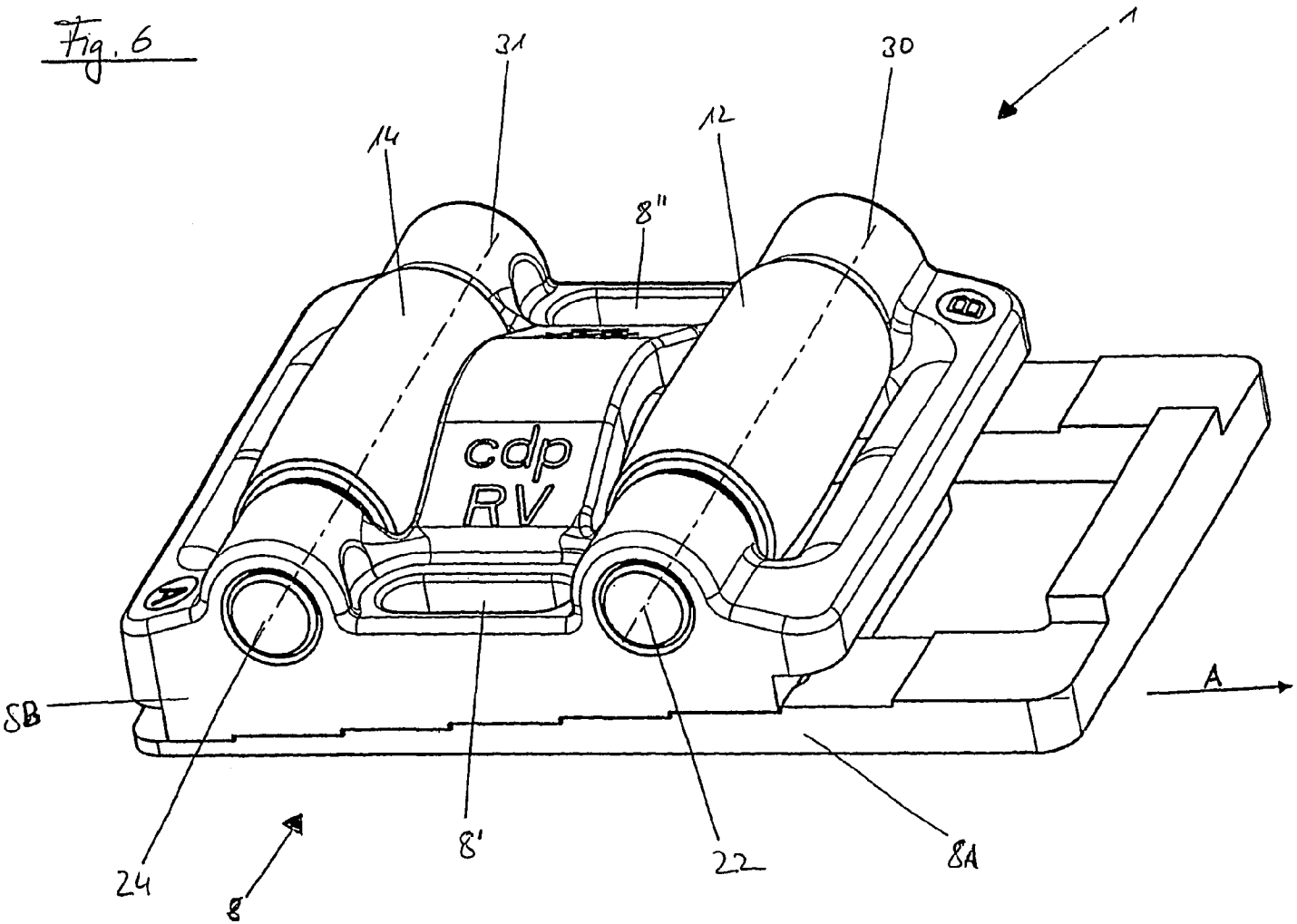
FIG. 6 shows a schematic perspective view of a second embodiment of the tongue lifting device according to the invention.

FIG. 6 shows a second embodiment of a tongue lifting device 1 according to the present invention. Tongue lifting device 1 has a base body 8 which in this embodiment consists of a bottom section 8A and a top section 8B. As in the first embodiment, in upper section 8B are supported carrier support pins 22, 24 which serve to pivotably support rollers 12, 14. The side of bottom section 8A oriented towards top section 8B is provided step-like with stepped shoulders of preferably the same height as well as the same surface, on which corresponding surfaces on the side opposing underside 8A of top section 8B are in contact. By displacing top section 8B in the direction of arrow A from FIG. 6 it is possible for a height adjustment of top section 8B to take place whereby the plane spanning central axes 30, 31 of carrier support pins 22, 24 is displaced substantially parallel and without skewing in the direction of elevation. In addition oblong holes 8', 8" are formed in top section 8B through which the fixing elements (not shown), for example bolts, can engage through top section 8B into bottom section 8A in order to ensure fixing of top section 8B onto bottom section 8A in any disposition on the steps.

Figure 7:
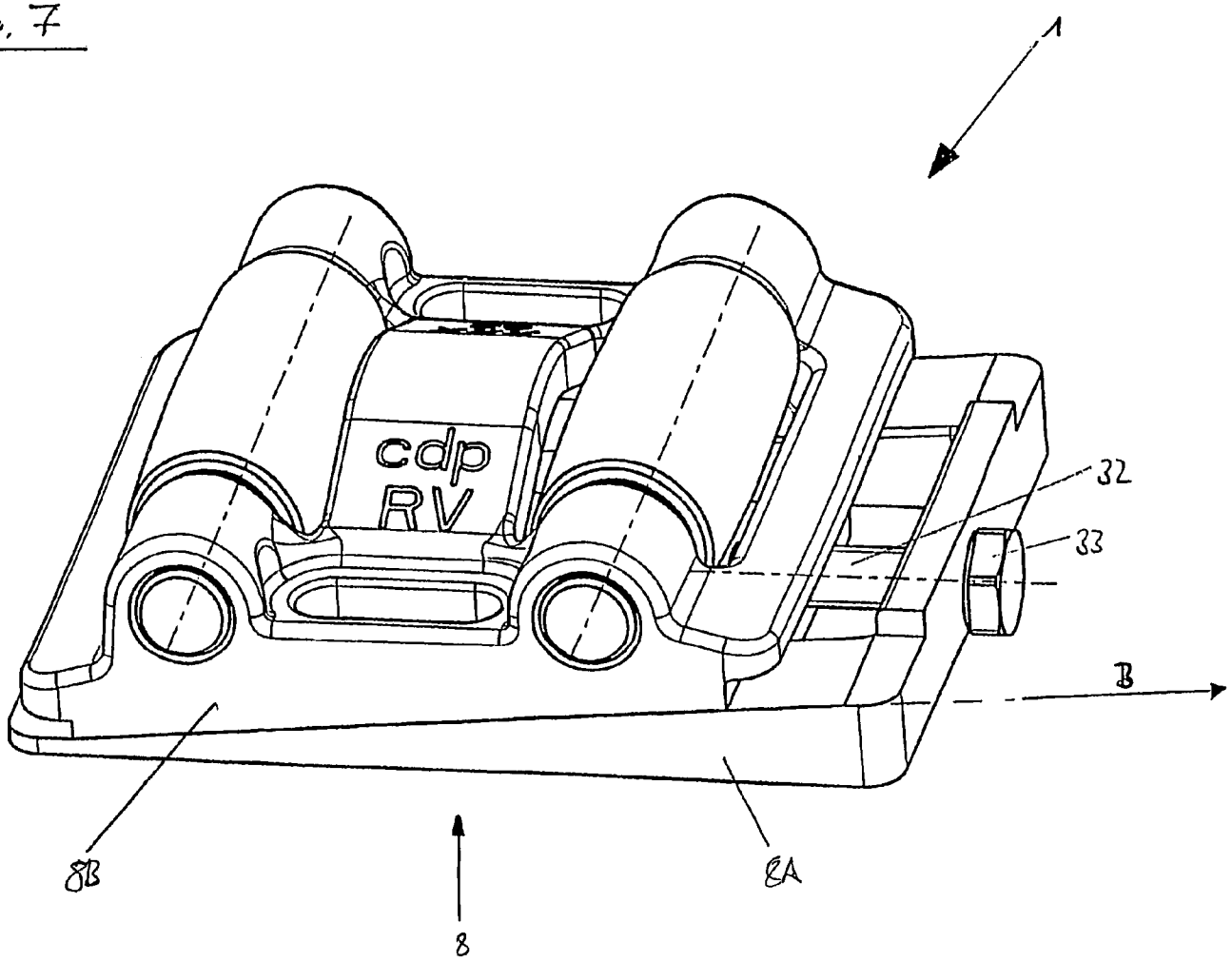
FIG. 7 shows a schematic perspective view of a third embodiment of the tongue lifting device according to the invention.

FIG. 7 shows a third embodiment of tongue lifting device 1 according to the invention in which base body 8 also comprises a top section 8B and a bottom section 8A. The joining surfaces of both sections 8A, 8B are provided with a continuous slanted plane which runs at an angle in relation to the plane spanned by the underside of bottom section 8A. Height adjustment of top section 8B in relation to bottom section 8A takes place in this case too by displacing top section 8B in the direction or opposing direction of arrow B from FIG. 7. In addition, a threaded rod 32 which ends outside base body 8 in a hexagon head 33 is connected to top section 8B and bottom section 8A. A tool (not shown) attached to this hexagon head 33 can apply a torque to threaded rod 32 and thus bring about stepless displacement of top section 8B on bottom section 8A.

The invention claimed is:

1. A device for lifting and displacing the tongue blade of a rail switch comprising at least two rollers, the axes of which are disposed substantially parallel to a running rail for displacing a tongue blade transversely to the running rail, at least two support carrier pins, each of which supports a roller, a base body which supports the support carrier pins, a projection on the rollers that extends in at least one first direction in relation to the body, and a covering between at least two adjacent rollers that is oriented towards the first direction and at least partially covers a passage between the at least two adjacent rollers, the base body having at least one bottom section and at least one top section disposed so as to be displaceable on the bottom section to adjust the height of the at least two rollers, wherein the direction of displacement between the bottom section and the top section of the base body is disposed at an angle to the plane of displacement of the tongue blade.

2. The device according to claim 1, wherein the bottom section and the top section have corresponding inclined faces on respective contact edges of the sections.

3. The device according to claim 2, wherein the corresponding inclined faces are formed in a plurality of steps.

4. The device according to claim 1 or 2, including a mechanism for displacing the top section on the bottom section.

5. The device according to claim 4, wherein the mechanism is a threaded rod which is connected to the top section and the bottom section.

6. The device according to claim 1, wherein the top section and the bottom section are capable of being fixed relative to each other in any displacement position.

7. The device according to claim 1, wherein the covering is at a distance of no more than 5.0 mm from an outer circumference of the at least two adjacent rollers.

8. The device according to claim 7, wherein the distance is no more than 30 mm.

9. The device according to claim 1, wherein the base body is a casting.

10. The device according to claim 9, wherein the base body is a casting integrally formed with the covering.

11. The device according to claim 1, wherein at least one roller of the at least two rollers has a projection in the first direction in relation to a reference point of the base body which is larger than that of the remaining rollers.

12. The device according to claim 1, having a first and a second roller wherein the first roller has a projection of 2.0 to 3.0 mm and the second roller has a projection of 3.0 to 4.0 mm in the first direction in relation to the base body.

13. The device according to claim 1, wherein the base body has an identification mark which indicates the projection of the rollers in each case.

14. The device according to claim 1, wherein the support carrier pins each have at least one limit stop element that limits an insertion depth of the support carrier pins into the base body.

15. The device according to claim 14, wherein the stop element is a collar.

16. The device according to claim 1, wherein the rollers are supported on the support carrier pins by friction bearings.

17. The device according to claim 16, wherein the friction bearing is a synthetic polymer layer between an inner circumferential surface of a roller and an outer circumferential surface of a carrier support pin.

18. The device according to claim 16, wherein the layer has self-lubricating properties.

19. The device according to claim 1, wherein the base body has a symmetrical axis which extends parallel to the rollers.

20. The device according to claim 1, wherein the at least two support carrier pins are provided so as to be incapable of displacement on the base body.

21. A method for height adjustment of a device according to claim 1, comprising displacing the top section, in relation to the bottom section, transversely to the running rail in a rail switch.

22. The method according to claim 21, wherein displacement of the top section on the bottom section is carried out manually.

23. The method according to claim 21, wherein displacement of the top section on the bottom section is carried out with a mechanism.

24. The method of claim 23, wherein the mechanism is a threaded rod.

25. The method according to claim 21, including loosening means for fixing the top section and the bottom section prior to the displacement and tightening the means for fixing after displacement.

26. The method of claim 25, wherein the fixing means are screws.

* * * * *